US006502610B1

(12) United States Patent
Stegmaier

(10) Patent No.: US 6,502,610 B1
(45) Date of Patent: Jan. 7, 2003

(54) CUTTER SUPPORT BODY FOR HIGH SPEED CUTTING HEADS FOR WOODWORKING

(75) Inventor: Bernd Stegmaier, Ellenberg (DE)

(73) Assignee: Hapro Holzbearbeitungswerkzeuge GmbH, Ellenburg (DE)

( * ) Notice: Subject to any disclaimer, the term of this patent is extended or adjusted under 35 U.S.C. 154(b) by 0 days.

(21) Appl. No.: 09/953,635

(22) Filed: Sep. 17, 2001

(51) Int. Cl.[7] ..... B27C 1/00; B27C 5/00

(52) U.S. Cl. ..... 144/218; 144/230; 407/33; 407/40

(58) Field of Search ..... 144/218, 230, 144/241, 114.1; 407/33, 40

(56) References Cited

U.S. PATENT DOCUMENTS 3,237,276 A * 3/1966 Von Der Ohe ..... 144/230
3,425,467 A * 2/1969 Willis ..... 144/218
3,866,844 A * 2/1975 Montgomery ..... 144/230
3,875,984 A * 4/1975 Plough ..... 144/218
5,005,619 A * 4/1991 Jensen ..... 144/230
6,161,602 A * 12/2000 Erbs ..... 144/218

* cited by examiner

*Primary Examiner*—W. Donald Bray
(74) *Attorney, Agent, or Firm*—Klaus J. Bach

(57) ABSTRACT

In a cutting blade support body for a wood working cutting head including a cylindrical support body with at least two recesses disposed in axial symmetry and extending over the full axial length of the cylindrical support body for receiving and supporting hard metal cutting blades, an annular plate is mounted on each end face of the cylindrical support body and extends over the axial ends of the recesses so as to radially fully cover the recesses and contain the cylindrical support body when exposed to high centrifugal forces.

2 Claims, 1 Drawing Sheet

CUTTER SUPPORT BODY FOR HIGH SPEED CUTTING HEADS FOR WOODWORKING

BACKGROUND OF THE INVENTION

The invention relates to a cutter support body for high speed cutting heads for woodworking.

Cutting heads for woodworking consist of a cylindrical support body provided at its circumference with at least two axially extending recesses, which are arranged in radial symmetry for the reception of cutter blade supports. The cutter blade supports disposed in these recesses consist generally of a backplate and a pressure member between which a hard metal cutter blade is firmly engaged in a form-locking manner and clamped by clamping screws which extend through threaded bores in the support body and engage the pressure member.

During woodworking, the cutting speed is relatively high and there is a trend to even higher speeds. Because of the high centrifugal forces generated in the process and the corresponding strain on the cutting head support body, however, the possible cutting speed is limited. For safety reasons cutting heads for operation at high speed require approval by an agency. Such approval is given on the basis of a test with an operating speed, which exceeds the design operating speed by 50%. It must be shown that there is no reaction to such an excessive speed which would appear to make even the slightest loosening of the engaged cutting blades or the cutting blade mounting structure possible. In this way, it is to be made sure that the cutting blades and mounting structure are not thrown outwardly during the high operation speeds.

With present designs, speeds of, for example, 12,000 rpm were not admissible. The deep radial recesses formed into the support body for the reception of the cutting blade mounting structures and the fact that the side walls of the recesses are forced apart in the circumferential direction by the clamping forces results, at higher speeds, in motion reactions of the cutting head body whereby the recesses are widened in circumferential direction, which is not acceptable.

It is therefore the object of the present invention to provide a cutting blade support body which can be employed for high speed applications at rpms which were not reachable so far.

SUMMARY OF THE INVENTION

In a cutting blade support body for a wood working cutting head including a cylindrical support body with at least two recesses disposed in axial symmetry and extending over the full axial length of the cylindrical support body for receiving and supporting hard metal cutting blades, an annular plate is mounted on each end face of the cylindrical support body and extends over the axial ends of the recesses so as to radially fully cover the recesses and contain the cylindrical support body when exposed to high centrifugal forces.

The annular blades cutting blade provided at opposite sides of the support body stiffen the support body in circumferential direction.

An embodiment of the invention will be described below in detail on the basis of the accompanying drawings.

DESCRIPTION OF A PREFERRED EMBODIMENT

Figure 1:
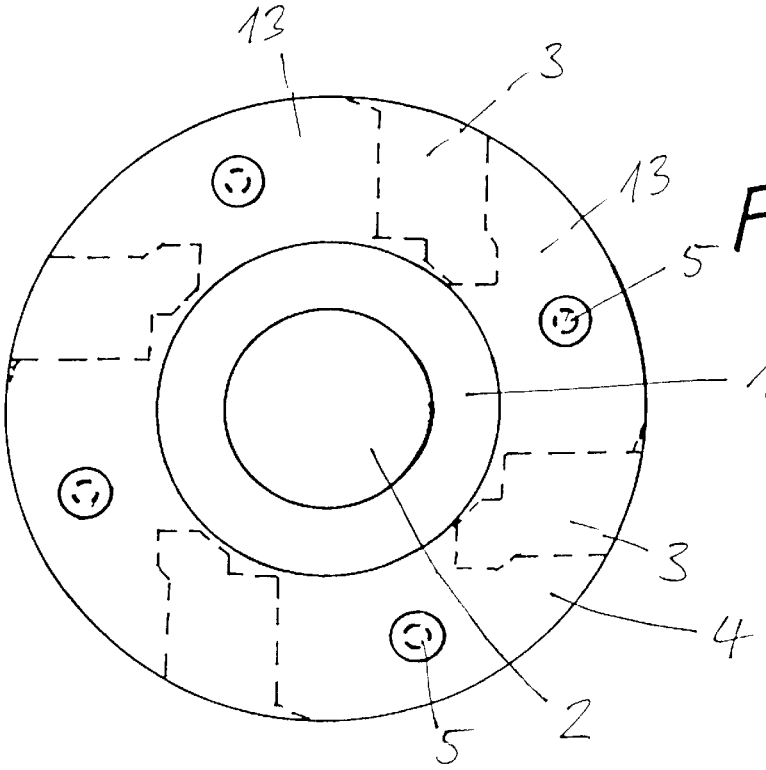
FIG. 1 is an axial view of a cutting blade support body according to the invention.

As shown in FIG. 1, a cutting blade support body 1 includes an axial through-bore 2 and a number of recesses equally spaced around the circumference of the support body 1 for the reception of cutting blades which are not shown in the drawings. Also, the clamping screw bores in which the clamping screws are disposed are not shown in FIG. 1 to simplify the representation. At opposite front ends, the cutting blade support body 1 is provided with an annular plate 4, which is screwed onto the cutting blade support body 1 by screws 5.

Figure 2:
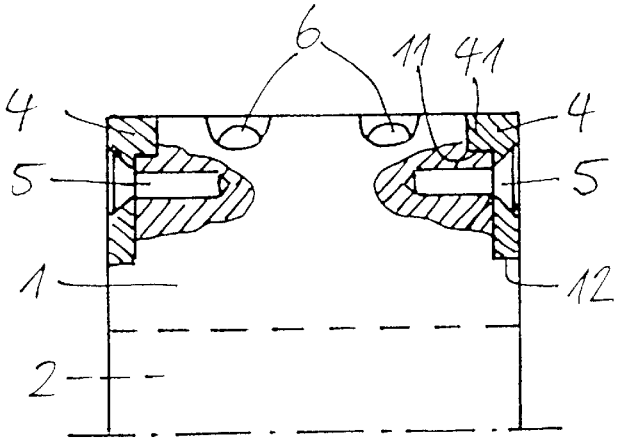
FIG. 2 is a view of half a body in radial direction and shown partially in section.

As shown in FIG. 2, each annular plate 4 has at its outer circumference a flange area 4 of increased thickness which extends over a shoulder 11 of the cutting blade support body 1. At its radially inner end, the annular plate is disposed on a shoulder 12 of the blade support body 1. In FIG. 2, also, the clamping screw bores 6 are visible which are not visible in FIG. 1 as they are hidden in that view.

With the design of the cutting blade support body 1 with the two annular plates 4, the blade support body areas 13, which are disposed in circumferential direction between the individual recesses 3, that extend over the full axial length of the body 1, are prevented by the annular plates 4 to move relative to each other in circumferential direction so that the recesses can not widen in circumferential direction. Furthermore, these areas are radially supported by the flanges 41 of the annular plates 4, which surround the body 1 in the area of the shoulder 11. The two annular plates 4 consequently act as reinforcement bands, which can take up large tension forces as they form circumferentially closed rings. As a result, the areas 13 of the cutting blade support body are retained in circumferential and in radial direction so as to prevent centrifugal force-induced expansion in radial direction.

What is claimed is:

1. A cutting head support body for wood working comprising a cylindrical support body with at least two recesses disposed in radial symmetry and extending over the full axial length of the cylindrical support body for receiving and supporting each a hard metal cutting blade, and an annular plate mounted on each end face of said cylindrical support body and extending over the axial ends of said recesses so as to radially fully cover said recesses, said annular plates having axially projecting thickened flange portions formed at their radially outer ends and said cylindrical support body being provided at its axially and radially outer ends with a shoulder onto which said thickened flange portions are fitted to extend over said recesses and firmly contain said cylindrical support body.

2. A cutting head according to claim 1, wherein said annular plates are connected to the end surfaces of the cylindrical body by screws screwed into end face areas of said cylindrical body which are disposed between said recesses.

* * * * *